US006283129B1

(12) United States Patent
Yuhara et al.

(10) Patent No.: US 6,283,129 B1
(45) Date of Patent: Sep. 4, 2001

(54) COSMETIC CASE

(75) Inventors: Yukitomo Yuhara, Chiba; Yuji Ideshita, Kanagawa, both of (JP)

(73) Assignee: Yoshida Industry Co. Ltd., Tokyo (JP)

( * ) Notice: Subject to any disclaimer, the term of this patent is extended or adjusted under 35 U.S.C. 154(b) by 0 days.

(21) Appl. No.: 09/424,280

(22) PCT Filed: Mar. 23, 1999

(86) PCT No.: PCT/JP99/01453

§ 371 Date: Nov. 19, 1999

§ 102(e) Date: Nov. 19, 1999

(87) PCT Pub. No.: WO99/48400

PCT Pub. Date: Sep. 30, 1999

(30) Foreign Application Priority Data

Mar. 20, 1998 (JP) ..... 10-072412

(51) Int. Cl.[7] ..... A45D 33/22

(52) U.S. Cl. ..... 132/295; 132/300; 132/293; 206/581

(58) Field of Search ..... 132/295, 294, 132/293, 300, 296; 206/581, 823, 235; 220/23.91, 23.87, 23.89, 844

(56) References Cited

U.S. PATENT DOCUMENTS 5,605,167 * 2/1997 Montoli ..... 132/294
5,735,297 * 4/1998 Litton ..... 132/294
5,909,738 * 6/1999 Quennessen ..... 132/293

FOREIGN PATENT DOCUMENTS 58-36331 8/1983 (JP) .
84116 * 6/1993 (JP) ..... 132/295

* cited by examiner

*Primary Examiner*—John J. Wilson
*Assistant Examiner*—Robyn Kieu Doan
(74) *Attorney, Agent, or Firm*—Harness, Dickey & Pierce, P.L.C.

(57) ABSTRACT

A cosmetic case includes a push piece integrally formed to a tray in order to reduce a number of parts and to simplify the assembly thereof.

The tray 14 for containing a cosmetic material P is received within a storage cavity 12*c* of a case body 12. The tray 14 and a cover 16 are pivotably joined with a rear extremity of the case body 12 by means of a single hinge 24. A hook mechanism 26 comprises a first latch 26*a* provided on the case body 12 and a second latch 26*b* provided on the cover 16. A push piece 30 for releasing the engagement of the hook mechanism 26 is integrally formed on the peripheral wall 14*b* of the tray 14, and has a pair of cantilever arms 30*a* and 30*b*, and a push button 30*c*. Each arm 30*a* and 30*b* has elasticity by itself and the push button 30*c* is integrally formed between a pair of the arms 30*a* and 30*b* to be movable by bending deformation of the arms 30*a* and 30*b*. The push button 30*c* of the push piece 30 is disposed within a recess 28 of the case body 12, and projects outside. By applying a pressure to the push button 30*c*, the engagement of the hook mechanism 26 can be released by means of conversion means 32.

8 Claims, 9 Drawing Sheets

COSMETIC CASE

TECHNICAL FIELD

This invention relates to a cosmetic case in which a push piece is integrally formed to a tray installed within a case body.

BACKGROUND ART

A cosmetic case having a tray is disclosed in Japanese Examined Utility Model Publication No.58-36331 (Int. Cl. A45D 33/22). In such a cosmetic case, each rear extremity of a case body, a tray, and a cover is pivotably joined by means of a single hinge. A puff is received in a hollow space between a bottom surface of the case body and the tray. When making up, the tray is opened to pick up the puff after the cover is opened. Then, a cosmetic material contained in the tray is rubbed off with the puff after the puff is picked up and the tray is closed.

At front extremities of the case body, the cover, and the tray, a clasp mechanism is installed to maintain their closed position. The clasp mechanism comprises two pairs of engageable tongues, one is formed at front extremities of the cover and the tray and the other is formed at front extremities of the tray and the case body. The cover closes both of the case body and the tray by engaging each tongue of the clasp mechanism. By such a way, the cosmetic material contained in the cosmetic case is protected. Further, a wedge-shaped push piece having slant surfaces at both upper and lower sides thereof is installed to the case body. When the push piece is pushed, the engagement of the clasp mechanism is released, and the cover and the tray are opened.

The push piece is formed separately from the case body, the tray, and the cover. The push piece is slidably inserted into a recess provided on a front wall of the tray, and the forward end of the push piece projects from a front wall of the case body. When the push piece is pushed in engaging condition of the clasp mechanism, the slant surfaces formed on each of the upper and lower sides of the push piece enter into between the case body and the cover to separate the case body and the cover, and hence release the engagement of the clasp mechanism.

As the push piece of the conventional cosmetic case is formed separately from the case body, the tray, and the cover as described above, in such a structure it is a problem that many parts are required. Further, the assembly of the cosmetic case has become complicated because the push piece is fabricated additionally. Thus, it has been expensive to manufacture the conventional cosmetic case.

DISCLOSURE OF THE INVENTION

An object of the invention is to provide a cosmetic case, which enables to reduce the number of parts and to simplify the assembly thereof by integrally forming a push piece to a tray.

Another object of the invention is to provide a cosmetic case, wherein good operation feeling of the push piece integrally formed to the tray is assured by a simple structure.

The invention comprises that a case body has a storage cavity therein, a cover is pivotably attached to the case body for opening and closing the case body, a tray is pivotably attached to the case body between the cover and the case body, is stored within the storage cavity and contains cosmetic material therein, a hook mechanism is provided between the case body and the cover for releasing and hooking an engagement of the case body and the cover, a push piece is integrally formed with the tray, both ends thereof is connected to the tray to be able to bend themselves elastically and a central portion thereof projects from the case body being movable by the bending deformation of the both ends, and conversion means is provided for releasing engagement of the hook mechanism by converting a pressure applied to the push piece into a pushing force for lifting up the cover.

When the push piece is pushed, the push piece is pushed in flexibly by the elastically bending deformation of both ends as pivots. By this way, a pressure for releasing the engagement of the hook mechanism can be adjusted freely depending upon the setting of the elasticity of both ends of the push piece, whereby the opening operation of the cover is improved.

Further, a number of parts of the cosmetic case is reduced because the push piece and the tray are formed in one-piece by integrally molding them. Thus, there is no need to assemble the push piece separately. Therefore, the assembly of the cosmetic case can be automated, and then the productivity of the cosmetic case is improved and the manufacture costs are reduced.

The both ends of the push piece comprise a pair of cantilever arms, one end of which is connected to the tray and another end is an free end, and the central portion of the push piece comprises a push button for applying the pressure, which is formed between the free ends of the arms.

The pressure applied to the push button is effected to the free ends of a pair of the arms to bend the arms appropriately and sufficiently. Even if the rigidity of the push piece including the push button and the tray as a whole is set high, the arms can be bent flexibly to obtain the shifting stroke of the push piece sufficiently. By such a way, operation feeling of the push piece can be enhanced. Further, leaning of the push button is prevented in operation, because a pair of arms supports the push button, and therefore, an operation feeling of the push button can be improved.

The arms of the push piece are thinly molded by thinly molding the tray at regions where the arms are formed.

This enables to bend the arms more sufficiently.

The push button of the push piece is made thicker and more rigid than that of the arms.

Thus, the deformation of the push button itself can be prevented when the push piece is pushed in.

The arms of the push piece are formed to the tray by a pair of U-shaped slits which are opposing each other, and the arms are formed to expand from the central portion of the push piece toward the both sides of the tray.

In this case, the push piece is formed in the shape of "$\pi$" by which the structure thereof becomes simple.

The arms of the push piece are formed to the tray by a pair of U-shaped slits, which are facing each other, and the arms are formed within a region of the width of the central portion of the push piece.

Since a distance between the ends of arms attached to the tray can be shortened, free ends thereof can be spaced as long as possible along the tray. By such a way, the width of the push button installed between free ends of the arms is adjusted more freely and it becomes possible to obtain the preferable width of the push button for good operation of the push button.

The conversion means is provided as a slant surface between the cover and the case body, and the slant surface abuts the central portion of the push piece to lift up the cover with respect to the case body in accordance with a movement of the central portion.

In particular, the slant surface is progressively inclined in the direction where a distance between the cover and the case body is narrowed in accordance with a movement of the central portion in a pushing operation.

When the push piece is pushed, the central portion of the push piece abutting the slant surface enters into between the case body and the cover, thereby the engagement of the hook mechanism is smoothly released by lifting up the cover against the case body. At this time, the movement of the push piece caused by the elastic bending deformation of the arms is appropriately guided, and then a pressure applied to the push piece is accurately converted into a pushing force for lifting up the cover. Further, since the conversion means comprises the mere slant surface, the structure thereof becomes simple.

A central portion of the push piece projects from the case body through a cutout section formed to the case body.

By providing the cutout section, the central portion of the push pieceintegrally formed to the tray in the storage cavity of the case body can project appropriately from the case body. Further, a movement of the push piece caused by the elastic bending deformation of the arms can also be guided accurately through the cutout section.

The hook mechanism comprises the first latch formed on the case body and the second latch formed on the cover to be engageable with the first latch.

The cover and the tray are pivotably joined to the case body by means of a single hinge joint.

A depth of the tray is formed shallower than that of the storage cavity so that a hollow space for receiving a cosmetic tool is provided below the tray within the storage cavity of the case body.

The cosmetic tool such as a puff or the like can be received in this space.

BEST MODE FOR CARRYING OUT THE INVENTION

Figure 1:
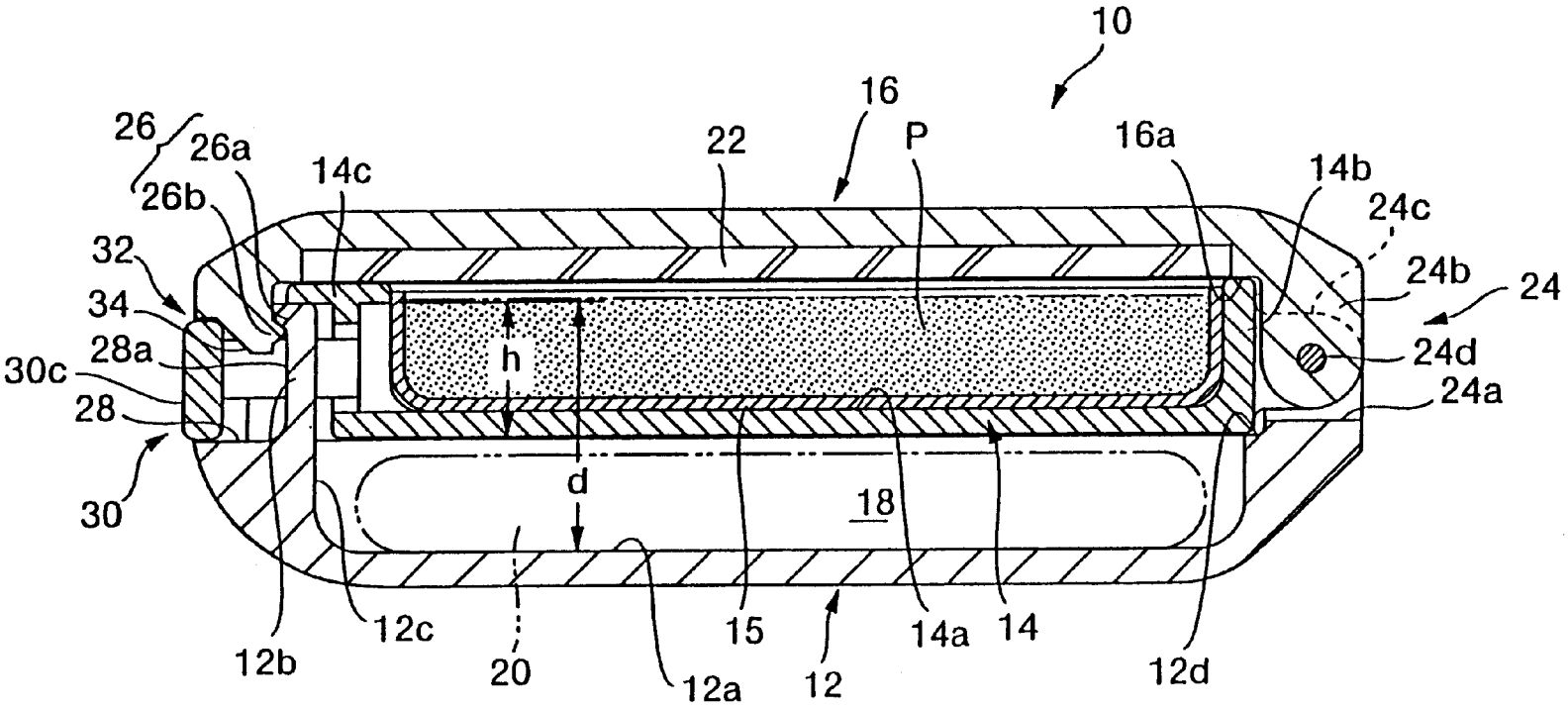
FIG. 1 is a sectional side elevation of the first embodiment of a cosmetic case according to the invention.

The following discussion will explain the first embodiment of the invention in detail with reference to the attached figures.

The embodiment comprises a case body 12 having a storage cavity 12*c* therein, a cover 16 pivotably hinged with the case body 12 for opening and closing the case body 12, a tray 14 pivotably hinged with the case body 12 and installed between the cover 16 and the case body 12 to be stored in the storage cavity 12*c*, and containing therein cosmetic material P, a hook mechanism 26 provided between the case body 12 and the cover 16 for releasing and hooking an engagement of the case body 12 and the cover 16, a push piece 30 integrally formed to the tray 14, both ends thereof being connected to the tray 14 to be able to deform bendably and elastically, and a center thereof projecting from the case body 12 and being movable by the bending deformation of both ends, and a conversion means 32 to convert a pressure applied to the push piece 30 into a push-up force for lifting up the cover 16 for releasing the engagement of the hook mechanism 26. The aforesaid end of the push piece 30 comprises cantilever arm, one end of which is connected to the tray 14 and another end is an free end, the center of the push piece 30 is formed as a push button 30*c* between free ends of these arms where the pressure is applied, and between the cover 16 and the case body, the conversion means 32 is formed as a slant surface 34 abutting the push button 30*c* of the push piece 30 to lift up the cover 16 against the case body 12 in accordance with a movement of the push button 30*c*.

Figure 2:
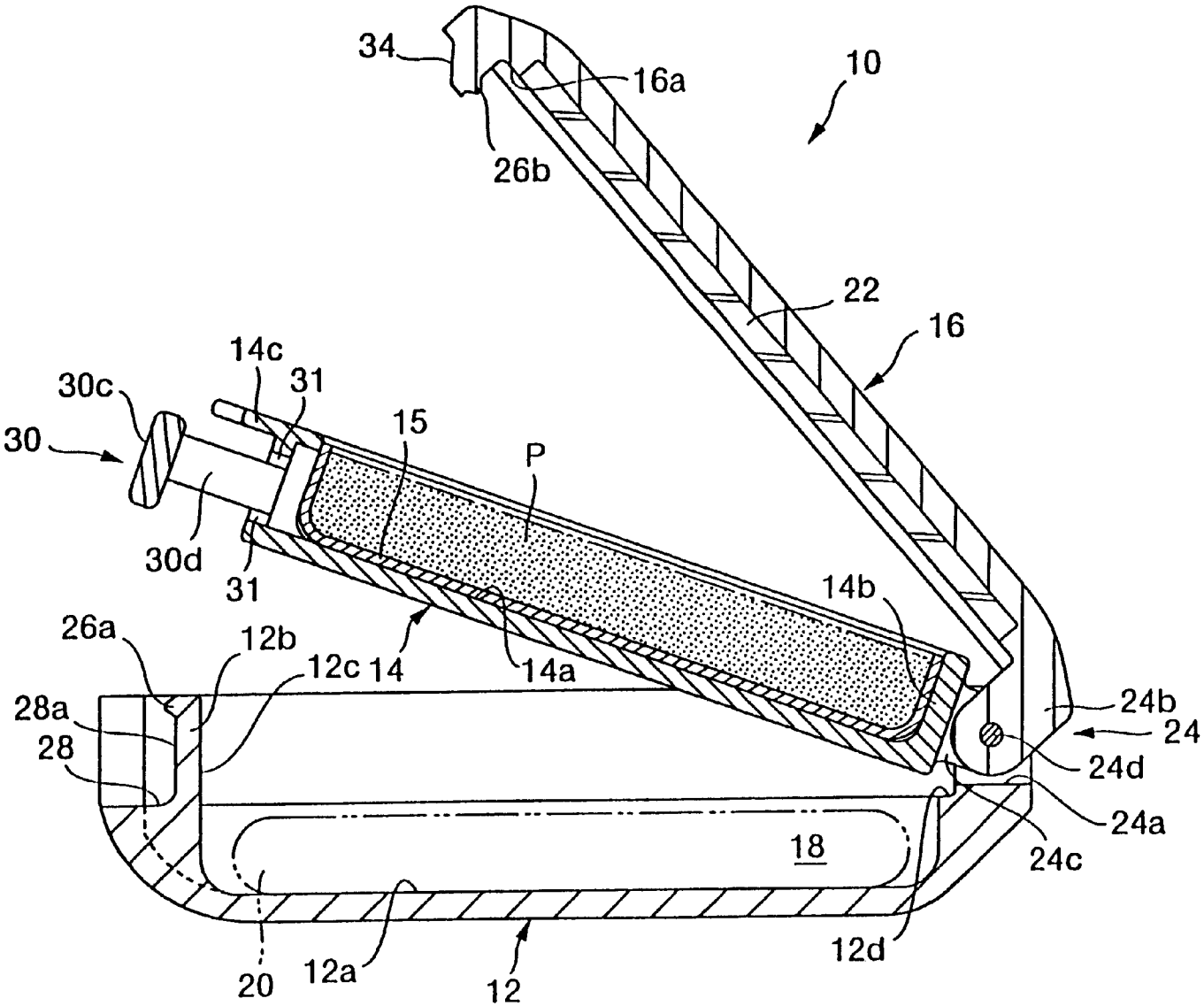
FIG. 2 is a sectional side elevation of the cosmetic case of FIG. 1, showing the manner in which a cover and a tray of the cosmetic case are opened.

The case body 12, the tray 14 and the cover 16 are the main components of the cosmetic case 10 of the first embodiment. A plate-like storage cavity 12*c* is provided within a space defined by a bottom surface 12*a* and a peripheral wall 12*b* of the case body 12 as shown in FIGS. 1 and 2.

The tray 14 is formed like a plate to be defined by a bottom surface 14*a* and a peripheral wall 14*b*. A plate 15 filled with the cosmetic material P is received in the tray 14 disposed within the storage cavity 12*c* of the case body 12. The flange 14*c* is formed along a forward edge and both sides of the periphery of the tray 14. The flange 14*c* abuts an upper surface of the peripheral wall 12*b* of the case body 12. The height h of the tray 14 between the lower surfaces of the flange 14*c* and the bottom surface 14*a* is lower than the depth d of the storage cavity 12*c*. Further, inside the rear extremity of the case body 12 and both sides of the peripheral wall 12*b* is formed a step portion 12*d* at a height where the lower surface of the tray 14 is positioned. That is, the lower periphery of the tray 14 contacts the step portion 12*d* when the tray 14 is received within the storage cavity 12*c*. In such a way, a hollow space 18 is formed between the tray 14 and the bottom surface 12*a* of the case body 12 to receive a puff 20 therein.

The cover 16 is formed in conformity with a configuration of the case body 12 to cover an entire upper surface of the case body 12. A mirror 22 is attached over an underside 16*a* of the cover 16. The surfaces of the underside 16*a* of the cover 16 and the mirror 22 are adapted to contact the upper surface of the flange 14*c* of the tray 14.

The rear extremities of the tray 14 and the cover 16 are pivotably joined to the rear extremity of the case body 12 through a single hinge joint 24. The hinge 24 comprises a recess 24*a* formed at the center of the peripheral wall 12*b* of the rear extremity of the case body 12, protrusions 24*b* and

24*c* formed at each of the rear extremities of the cover 16 and the tray 14, respectively, to be fitted into the recess 24*a*, and a pin 24*d* inserted into the protrusions 24*b* and 24*c* from both sides of the case body 12. As shown in FIG. 2, the cover 16 and the tray 14 are rotated around the hinge 24.

Figure 3:
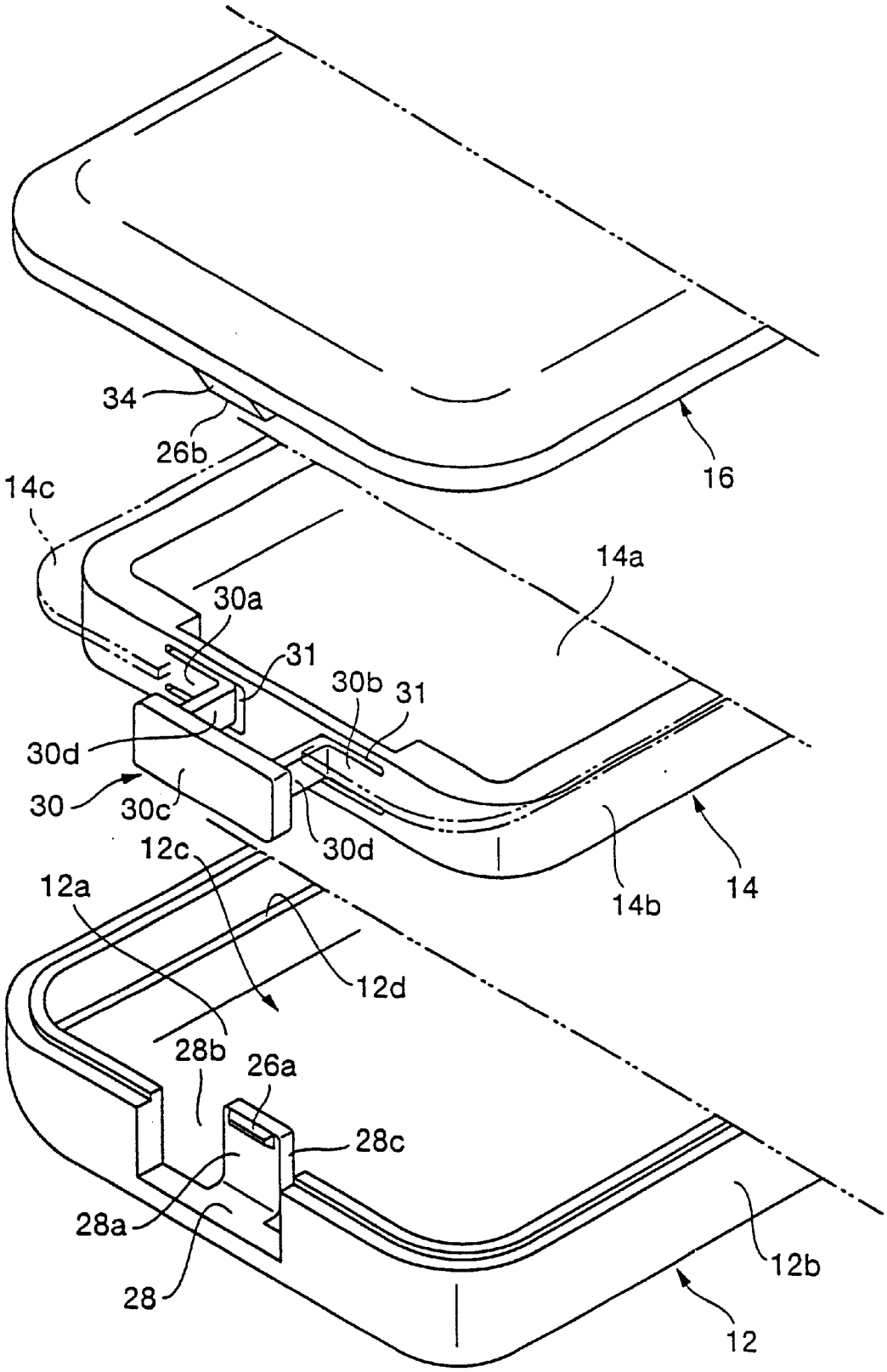
FIG. 3 is an enlarged exploded perspective view of a main part of the cosmetic case of FIG. 1.

The hook mechanism 26 is installed between front extremities of the case body 12 and the cover 16. The engagement of the hook mechanism 26 keeps the case body 12 in a closed position. The hook mechanism 26 comprises the first latch 26*a* and the second latch 26*b*. The first latch 26*a* is formed on an upper end of the rear vertical wall 28*a* of the recess 28 formed at the center of the front side of the peripheral wall 12*b* of the front extremity of the case body 12, and the second latch 26*b* is formed on a back of the front extremity of the cover 16. The hook mechanism 26 is hooked and released by engaging and disengaging the first latch 26*a* and the second latch 26*b*. Cutout sections 28*b* and 28*c* are formed at positions adjacent to both sides of the rear vertical wall 28*a* of the recess 28 as shown in FIG. 3.

The push piece 30 is provided at the front extremity of the case body 12. The engagement of the hook mechanism 26 is released by operating the push piece 30. As shown in FIG. 3, the push piece 30 comprises a pair of cantilever arms 30*a* and 30*b*, and the push button 30*c*. The cantilever arms 30*a* and 30*b* are integrally formed on the peripheral wall 14*b* of the front side of the tray 14. The push button 30*c* is integrally formed between front ends of a pair of the arms 30*a* and 30*b* and projects outside from the case body 12. At regions where the arms 30*a* and 30*b* are formed the peripheral wall 14*b* is made thin.

The arms 30*a* and 30*b* are formed by a pair of U-shaped slits 31 provided on the peripheral wall 14*b*. Each of the arms 30*a* and 30*b* have L-shaped extensions 30*d*, which are formed forward from the peripheral wall 14*b*. The push piece 30*c* is formed at the front ends of the extensions 30*d*. The extensions 30*d* of the arms 30*a* and 30*b* are disposed within the cutout sections 28*b* and 28*c* in the recess 28. The push button 30*c* projects outside from the case body 12, while being kept in the recess 28. The push button 30*c* can move backward and forward in the recess 28 by bending deformation of the arms 30*a* and 30*b*. Further, the push button 30*c* is made thicker and more rigid than the arms 30*a* and 30*b*, so that the push button 30*c* is adapted to move by bending the arms 30*a* and 30*b*.

The engagement of the hook mechanism 26 is adapted to be released by pushing in the push button 30*c*, namely it can be accomplished by a conversion means 32, which converts a pressure applied on the push button 30*c* into a push-up force to lift up the cover 16. The conversion means 32 comprises a slant surface 34 formed on a lower side of the second latch 26*b*. The slant surface 34 is smoothly inclined downwardly toward the back of the cosmetic case 10, namely toward the inside of the case body 12. The slant surface 34 contacts the upper edge of the push button 30*c* of the push piece 30 and the bottom surface of the recess 28 contacts the lower edge of the push button 30*c*.

Figure 4:
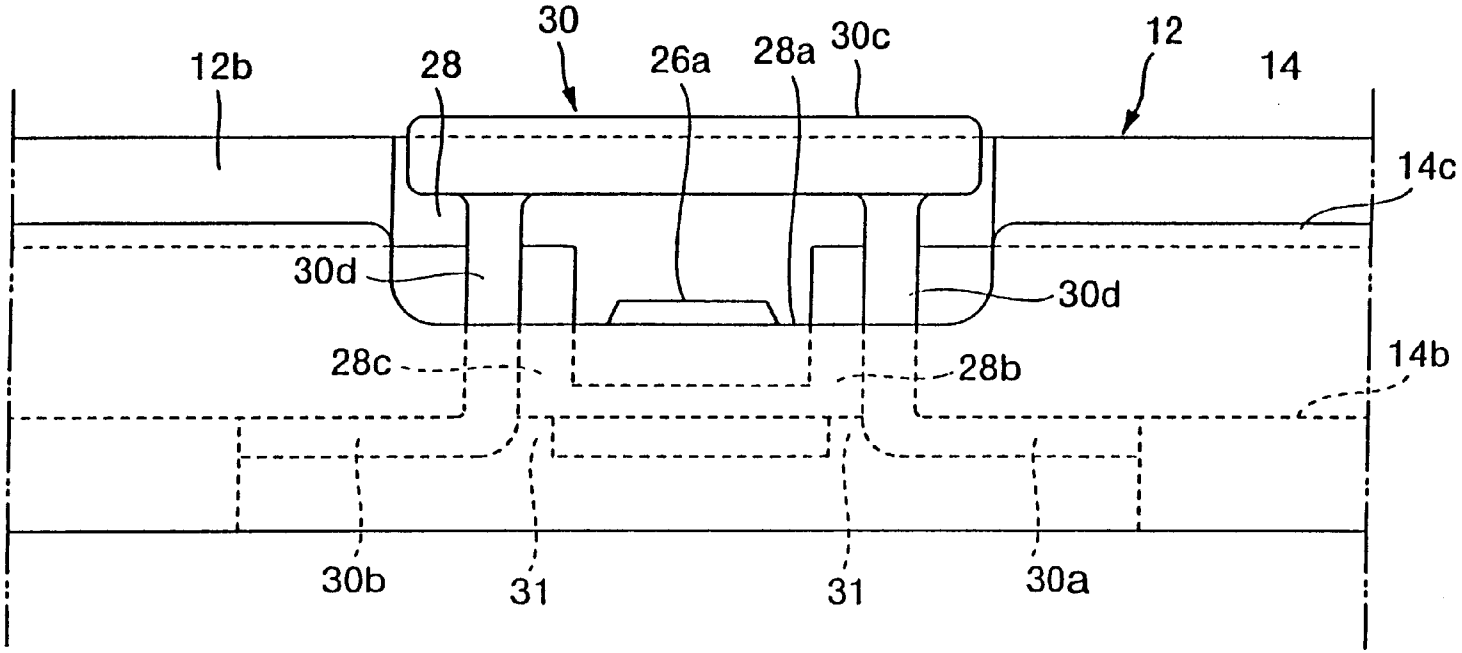
FIG. 4 is an enlarged plan view of the main part of the cosmetic case of FIG. 1, showing the manner in which a push piece is not operated.
Figure 6:
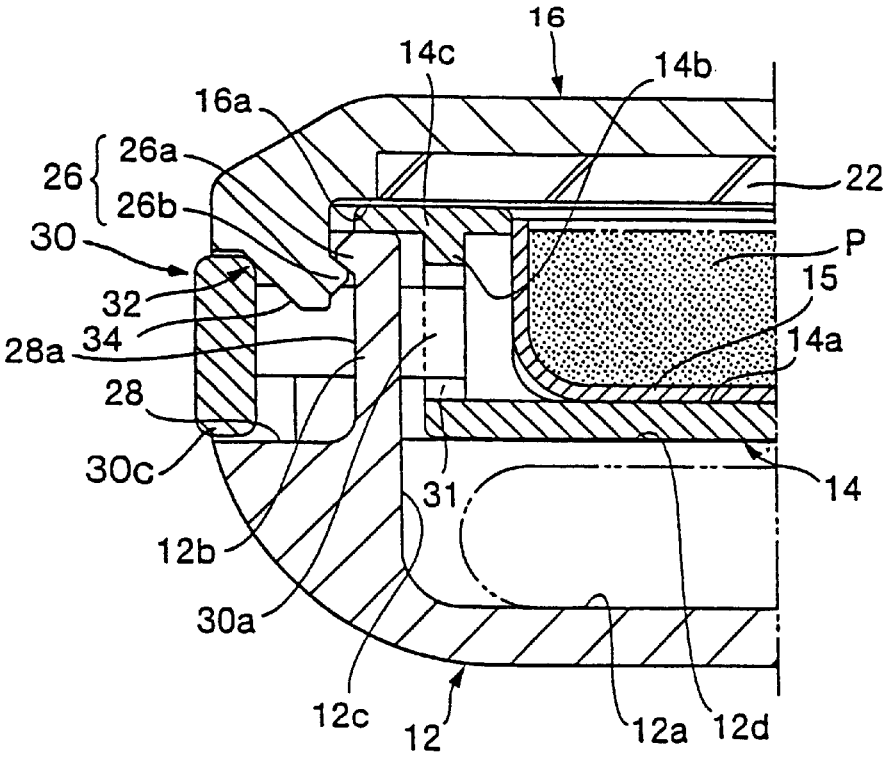
FIG. 6 is an enlarged sectional view of the main part of the cosmetic case of FIG. 1, showing the manner in which the hook mechanism is engaged.

In the cosmetic case of the first embodiment having above structure as shown in FIG. 1, when the cover 16 closes the case body 12 receiving the tray 14, the hook mechanism 26 is hooked by engaging the first latch 26*a* and the second latch 26*b* and the push button 30*c* of the push piece 30 is positioned forward in the recess 28 of the case body 12, as shown in FIGS. 4 and 6.

When the cosmetic case 10 is used, the engagement of the hook mechanism 26 is released firstly by pushing the push button 30*c* of the push piece 30. Then, by the cover 16 is opened, the cosmetic material P contained within the plate 15 in the tray 14 is exposed. The puff 20 is took out by opening the tray 14, because the puff 20 is received in the space 18 between the tray 14 and the case body 12. Subsequently, it becomes possible to make up by using the puff 20. After finishing the make-up, the puff 20 is returned to the space 18 and the cover 16 is closed to engage the hook mechanism 26. Then, the case body 12 is closed and the cosmetic material P can be protected.

Figure 7:
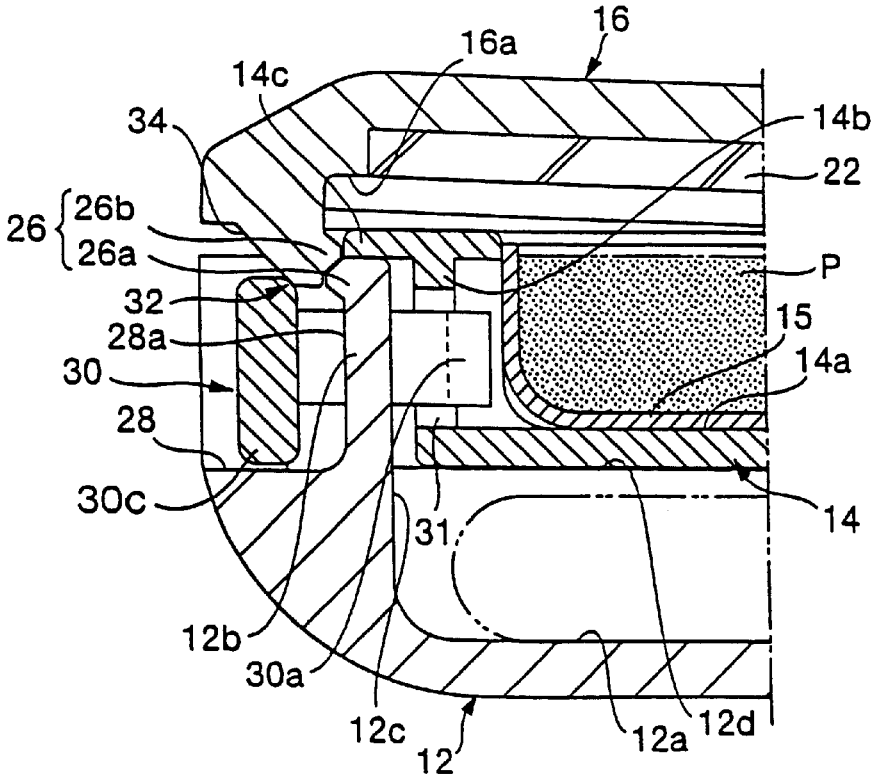
FIG. 7 is an enlarged sectional view of the main part of the cosmetic case of FIG. 1, showing the manner in which the hook mechanism is released.

As shown in FIG. 7, when the push button 30*c* is forcedly pushed in, the upper edge of the push button 30*c* pushes up the slant surface 34 to release the engagement of the hook mechanism 26. Then, the engagement of the first and the second latches 26*a* and 26*b* is released. While the slant surface 34 is lifted up, the push button 30*c* is supported upon the bottom surface of the recess 28 abutting thereto.

Figure 5:
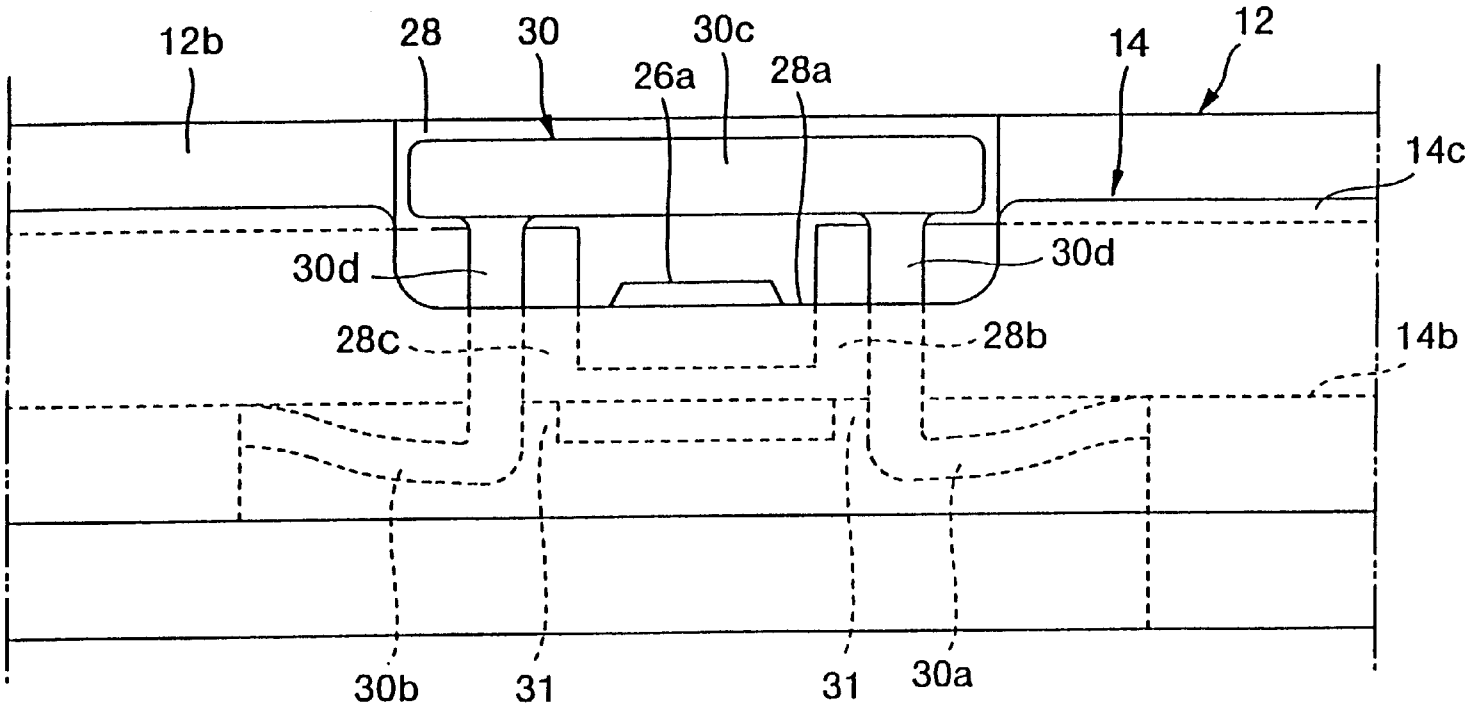
FIG. 5 is an enlarged plan view of the main part of the cosmetic case of FIG. 1, showing the manner in which the push piece is pushed.

In particular to the first embodiment, with respect to the push piece 30 including the push button 30*c*, a pair of arms 30*a* and 30*b* is bent by a relatively small pressure, when the push button 30*c* is pushed as shown in FIG. 5. Thereby, there needs a small pressure to push the push button 30*c* provided between the forward ends of the arms 30*a* and 30*b*, and it becomes possible to release easily the engagement of the hook means 26.

The push piece 30 is formed in the shape of"π" by a pair of arms 30*a* and 30*b* integrally molded with the tray 14 and the push button 30*c* integrally molded between the forward ends of these arms 30*a* and 30*b*. Such a shape simplifies the structure of the push piece 30.

Furthermore, a number of parts of the cosmetic case 10 is reduced because the push piece 30 and the tray 14 are integrally formed into a single part by integral molding. Accordingly, there is no need to assemble the push piece separately. As a result, the productivity of the cosmetic case 10 is improved and its manufacturing cost is reduced.

Further, the push button 30 is adapted to be operated by bending a pair of cantilever arms 30*a* and 30*b*, so that even if the rigidity of the push button 30*c* is high, it becomes possible to obtain sufficient stroke of the push piece 30. In other words, when the push piece 30 is pushed, the deformation of the push button 30*c* itself can be prevented because the push button 30*c* is made highly rigid. Further, leaning of the push button 30*c* can also be prevented while it is operated, because the push button 30*c* is supported by a pair of arms 30*a* and 30*b*. Therefore, the operation feeling of the push button 30*c* can be enhanced.

Further, in the first embodiment, since the conversion means 32 comprises the mere slant surface 34, the structure of the conversion means 32 is made quite simple.

Figure 8:
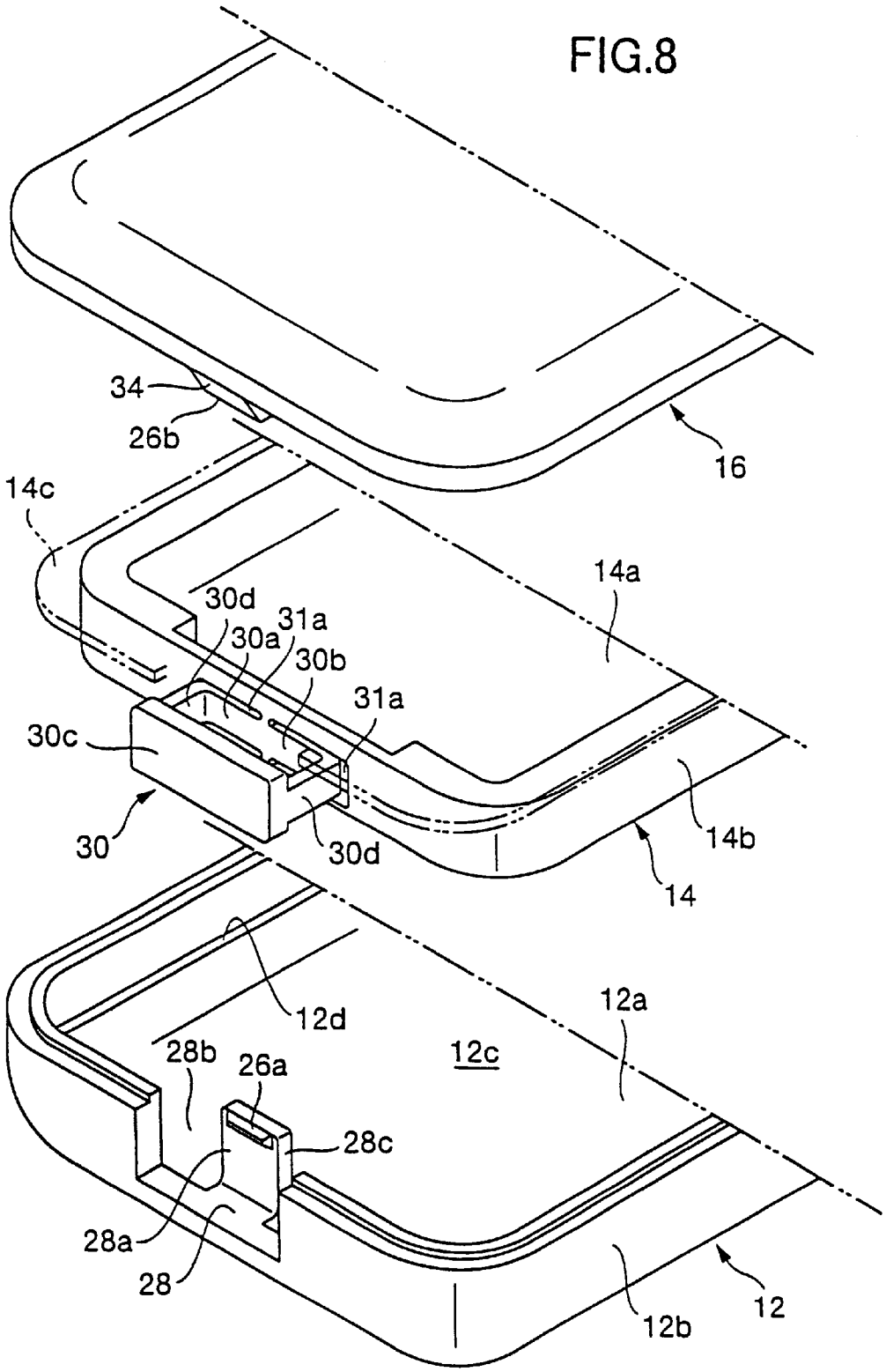
FIG. 8 is an enlarged exploded perspective view of a main part of the second embodiment of the cosmetic case according to the invention.
Figure 9:
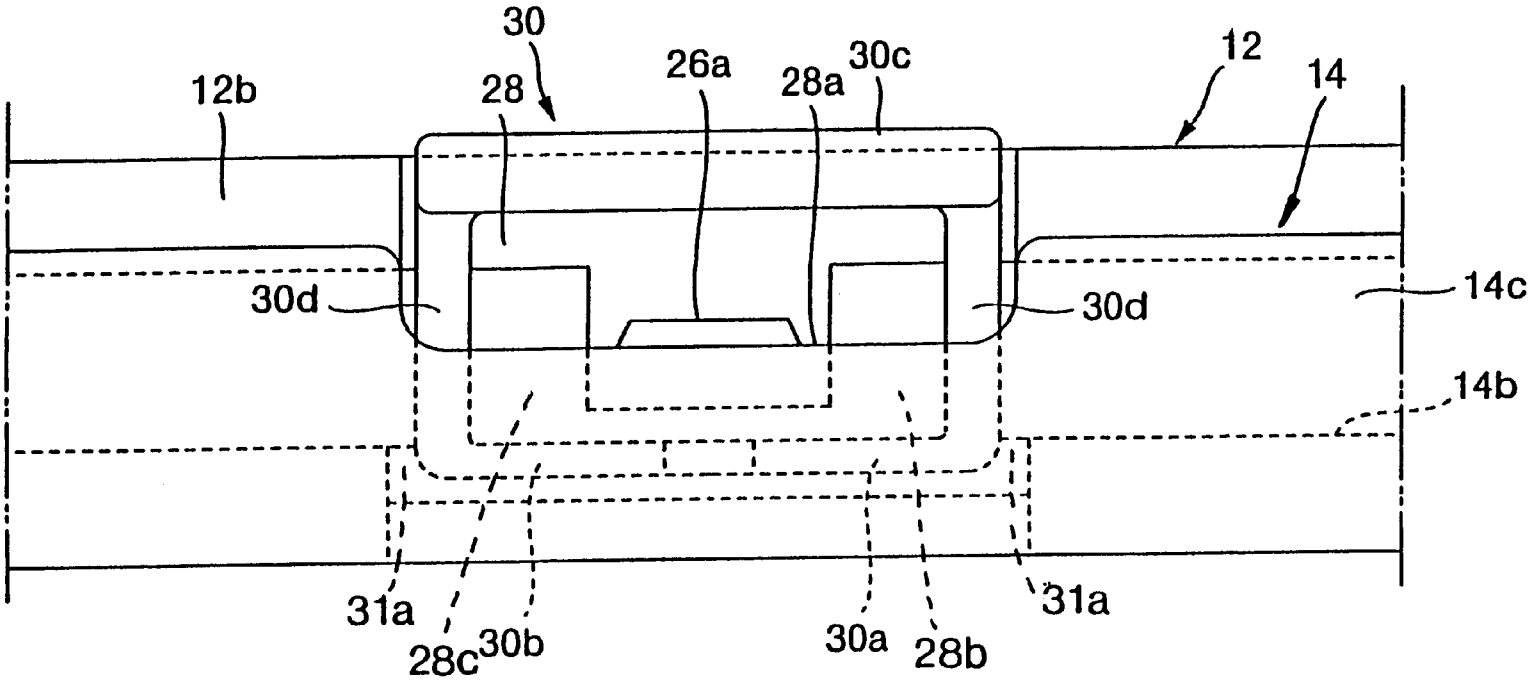
FIG. 9 is an enlarged plan view of the main part of the cosmetic case of FIG. 8, showing the manner in which a push piece is not operated.
Figure 10:
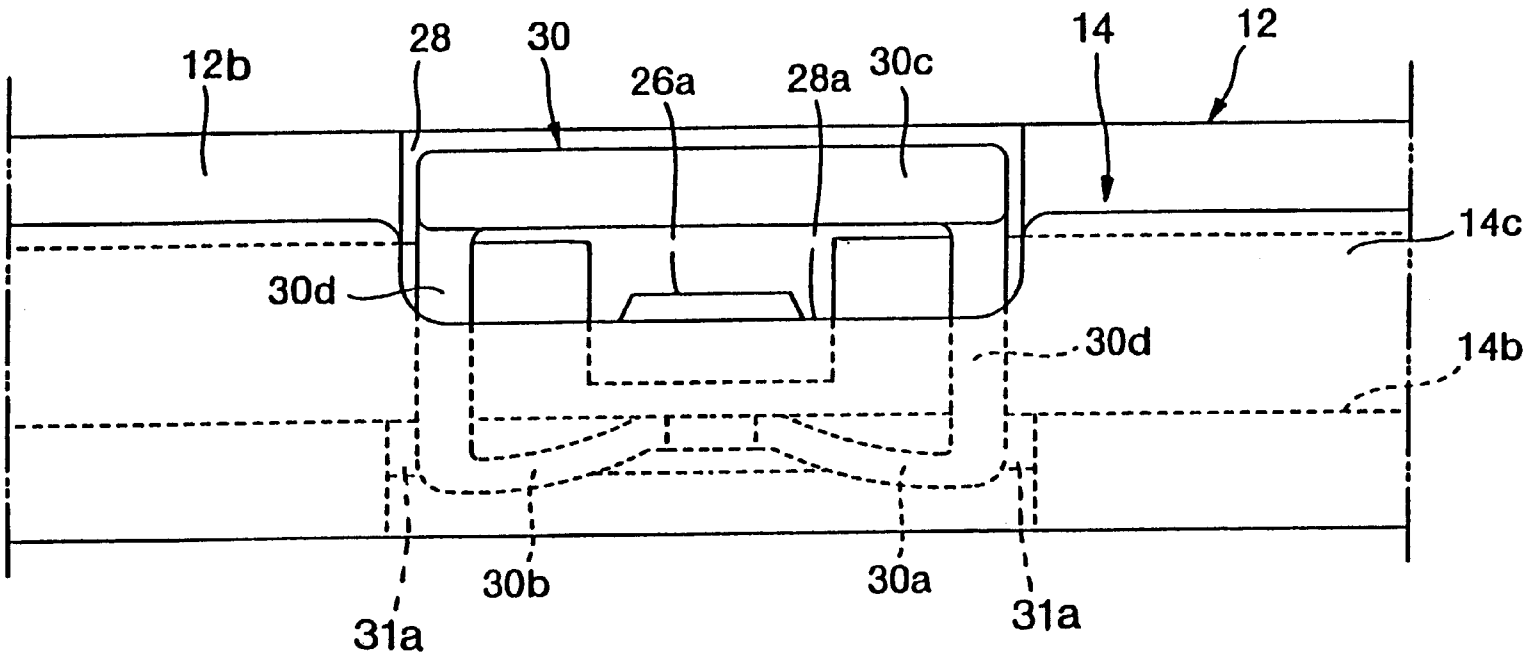
FIG. 10 is an enlarged plan view of the main part of the cosmetic case of FIG. 8, showing the manner in which the push piece is pushed.

FIGS. 8 through 10 show the second embodiment of the invention.

In the second embodiment, the arms 30*a* and 30*b* of the push piece 30 are formed by a pair of U-shaped slits 31*a* which are facing each other. In the first embodiment, the arms 30*a* and 30*b* are formed by a pair of U-shaped slits 31 which are opposing each other. Namely, the arms in the first embodiment are formed to expand from the push button 30*c* toward the both sides of the tray 14. On the other hand, the arms 30*a* and 30*b* in the second embodiment are formed within a region of the width of the push button 30*c*.

In the first embodiment, each slit 31 is formed outside each extension 30*d* within a length of the peripheral wall 14*b* of the front side of the tray 14. Therefore, the width of the push button 30*c* of the push piece 30 is limited to the length of each slit 31. On the contrary, in the second embodiment, each slit 31*a* is formed between the extensions 30*d*, so that it becomes possible to expand the distance between each extension 30*d* to the width of the peripheral wall 14*b* of the front side of the tray 14. Then, it becomes possible to arrange the width of the push button 30*c* of the push piece 30 freely within the length of the peripheral wall 14*b* of the tray 14. That is, the width of the push button 30*c* provided between extensions 30*d* can be arranged more freely than that in the first embodiment, so that it becomes possible to adjust the width of the push button 30*c* to obtain a best operation feeling of the push piece 30.

Of course, in the second embodiment, the push button 30*c* can be pushed in sufficient stroke by bending deformation of the arms 30*a* and 30*b*. Further, by integrally forming the push piece 30 and the tray 14, it is possible to reduce a number of parts and simplify the assembly of the cosmetic case 10.

What is claimed is:

1. A cosmetic case comprising:

a case body having a storage cavity therein;

a cover pivotably attached to said case body for opening and closing said case body;

a tray pivotably attached to said case body between said cover and said case body, being stored within said storage cavity and containing cosmetic material therein;

a single hinge pivotably joining said cover and said tray to said case body;

a hook mechanism provided between said case body and said cover for releasing and hooking an engagement of said case body and said cover;

a push piece having a pair of cantilever arms formed on both ends thereof and a push button formed on a central portion thereof for applying a pressure, said arms being elastically bendable by means of one end of said arms integrally connected to said tray and another end of said arms being a free end and said push button located between said free ends of said arms and projecting from said case body being movable by the bending deformation of said arms; and a conversion means for releasing engagement of said hook mechanism by converting a pressure applied to said push piece into a pushing force for lifting up said cover;

wherein said arms of said push piece are formed to said tray by a pair of U-shaped slits which are facing each other and said arms are formed within a region of the width of said push button of said push piece so as to be able to adjust a width of said push button freely along said tray.

2. A cosmetic case as set forth in claim 1 wherein said arms of said push piece are thinly molded by thinly molding said tray at regions where said arms are formed.

3. A cosmetic case as set forth in claim 1 wherein said push button of said push piece is set to be thicker and more rigid than that of said arms.

4. A cosmetic case as set forth in claim 1 wherein said conversion means is provided as a slant surface between said cover and said case body, said slant surface abutting said central portion of said push piece to lift up said cover with respect to said case body in accordance with a movement of said central portion.

5. A cosmetic case as set forth in claim 1 wherein said slant surface is formed to said cover and is progressively inclined in the direction where a distance between said cover and said case body is narrowed in accordance with a movement of said central portion in a pushing operation.

6. A cosmetic case as set forth in claim 1 wherein said central portion of said push piece projects from said case body through a cutout section formed to said case body.

7. A cosmetic case as set forth in claim 1 wherein said hook mechanism includes a first latch formed on said case body and a second latch formed on said cover to be engageable with said first latch.

8. A cosmetic case as set forth in claim 1 wherein a depth of said tray is formed shallower than that of said storage cavity so that a hollow space for receiving a cosmetic tool is provided below said tray within said storage cavity of said case body.

* * * * *